US007394910B2

(12) United States Patent
Smith et al.

(10) Patent No.: US 7,394,910 B2
(45) Date of Patent: Jul. 1, 2008

(54) AMBIDEXTROUS EARPIECE

(75) Inventors: Richard C. Smith, Costa Mesa, CA (US); Diann Y. Smith, Costa Mesa, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 10/769,158

(22) Filed: Jan. 29, 2004

(65) Prior Publication Data

US 2005/0008180 A1 Jan. 13, 2005

Related U.S. Application Data

(60) Provisional application No. 60/443,667, filed on Jan. 30, 2003.

(51) Int. Cl.
*H04R 25/00* (2006.01)

(52) U.S. Cl. ..... 381/322; 381/328

(58) Field of Classification Search ..... 381/312, 381/322, 324, 328, 330, 380–382; 181/129–130, 181/135

See application file for complete search history.

(56) References Cited

U.S. PATENT DOCUMENTS

| | | | | | |
|---|---|---|---|---|---|
| 1,614,987 | A | * | 1/1927 | Langenbeck et al. | 181/135 |
| 2,535,258 | A | * | 12/1950 | Bland | 181/135 |
| D176,810 | S | | 1/1956 | Norris | |
| 3,041,856 | A | * | 7/1962 | Neal | 63/14.1 |
| 3,614,344 | A | * | 10/1971 | Gorike | 381/371 |
| 3,676,611 | A | * | 7/1972 | Stephens | 381/324 |
| 3,787,643 | A | * | 1/1974 | Nielsen | 381/327 |
| 4,020,297 | A | | 4/1977 | Brodie | |
| D272,904 | S | | 3/1984 | Kawano | |
| 4,720,857 | A | * | 1/1988 | Burris et al. | 379/430 |
| 4,724,922 | A | | 2/1988 | Kalayjian | |
| 4,870,688 | A | | 9/1989 | Voroba et al. | |
| 4,878,560 | A | | 11/1989 | Scott | |
| 4,965,838 | A | * | 10/1990 | Kamon et al. | 381/380 |
| 5,048,092 | A | * | 9/1991 | Yamagishi et al. | 381/380 |
| D350,961 | S | | 9/1994 | Nakamura | |
| 5,412,736 | A | * | 5/1995 | Keliiliki | 381/381 |
| 5,659,156 | A | * | 8/1997 | Mauney et al. | 181/130 |
| D383,757 | S | | 9/1997 | Dobrusskin et al. | |
| 5,677,964 | A | * | 10/1997 | Sun | 381/385 |
| 5,949,896 | A | * | 9/1999 | Nageno et al. | 381/328 |
| 6,035,961 | A | | 3/2000 | Sun | |

(Continued)

OTHER PUBLICATIONS

Otto Comunications Advertisement, "Stick It In Your Ear", Law Enforcement Technology, Jul. 1998, p. 55.

(Continued)

*Primary Examiner*—Melur Ramakrishnaiah
*Assistant Examiner*—Phylesha L Dabney
(74) *Attorney, Agent, or Firm*—MacPherson Kwok Chen & Heid LLP; Norman E. Carte

(57) ABSTRACT

An earpiece suitable for use with two-way radios is configured to be captured at least partially within the conchae of an ear. The earpiece is configured for use in either ear. The earpiece is particularly suited for use by police and security personnel because it reduces costs associated with the manufacture, purchase, and inventory thereof, while allowing both the radio and ambient sound to be readily heard through both ears.

22 Claims, 4 Drawing Sheets

U.S. PATENT DOCUMENTS

| | | | | |
|---|---|---|---|---|
| 6,122,388 | A * | 9/2000 | Feldman | 381/322 |
| 6,411,722 | B1 | 6/2002 | Wolf | |
| D469,755 | S | 2/2003 | Hlas et al. | |
| D470,122 | S | 2/2003 | Hlas et al. | |
| D470,123 | S | 2/2003 | Hlas et al. | |
| 6,704,429 | B2 * | 3/2004 | Lin | 381/380 |
| 6,810,987 | B1 * | 11/2004 | DeKalb | 181/129 |
| 2002/0080990 | A1 * | 6/2002 | Lin | 381/380 |
| 2002/0096391 | A1 * | 7/2002 | Smith et al. | 181/135 |
| 2002/0172386 | A1 * | 11/2002 | Bayer | 381/330 |
| 2004/0165743 | A1 * | 8/2004 | Bayer | 381/330 |
| 2005/0031146 | A1 * | 2/2005 | Baskerville | 381/328 |
| 2005/0111686 | A1 * | 5/2005 | Bayer | 381/330 |

OTHER PUBLICATIONS

Otto Comunications Advertisement/Brochure Insert, "Which Communication Product Isn't Offered By Otto?"Carpentersville, IL.

Otto Comunications Product Brochure, "Your Specialist in Two-Way Radio Accessories".

* cited by examiner

AMBIDEXTROUS EARPIECE

PRIORITY CLAIM

This patent application claims the benefit of the priority date of U.S. Provisional Patent Application Ser. No. 60/443,667, filed on Jan. 30, 2003 and entitled Earpiece And Audio Communications Link pursuant to 35 USC 119. The entire contents of this provisional patent application are hereby expressly incorporated by reference.

FIELD OF THE INVENTION

The present invention relates generally to earpieces such as those commonly used by police and security personnel to facilitate listening to two-way radios. The present invention relates more particularly to an ambidextrous earpiece that is suitable for being worn in the conchae of either ear while allowing the wearer to hear outside or ambient sound.

BACKGROUND OF THE INVENTION

Earpieces for use by police and security personnel are well known. Such earpieces are used to facilitate listening to two-way radios and the like. Thus, such earpieces allow the police or security personnel to hear important communications that may affect their safety and/or the safety of others.

An earpiece is typically connected to a radio by a communications link, which typically comprises the combination of a length of acoustic tubing and a length of electrical cable. The acoustic tubing extends from the earpiece to a transducer, such as a small speaker. The electrical cable extends from the transducer to the radio.

Thus, electrical signals from the radio travel via the electrical cable to the transducer, where they are converted into acoustic signals. The acoustic signals then travel via the acoustic tubing from the transducer to the earpiece, where they can be heard.

Generally, the acoustic tubing proximate the earpiece will be coiled, so as to readily provide a desired length of tubing, while at the same time taking up any slack.

Typically, a single earpiece is worn in a selected ear. The selected ear may be chosen such that routing of the communications link is convenient in light of the placement of the radio and/or other gear. The selected ear may also be chosen merely as a matter of personal preference.

That is, in some instances the overall configuration of a person's gear may make it more convenient to wear the radio on the right side. In this instance it is generally preferred that the communications link be routed along the right side, thus generally making it preferably to wear the earpiece on the right side.

However, in other instances the overall configuration of the person's gear may make it more convenient to wear the radio on the left side. In this instance it is generally preferred that the communications link be routed along the left side, thus generally making it preferably to wear the earpiece on the left side.

Occasionally, it is desirable to change the ear in which the earpiece is worn. This may be necessitated by a change in the configuration of the wearer's gear, or again may merely be a matter of personal preference.

Contemporary earpieces that are used by police and security personnel with two-way radios are dedicated to either the right or left ear. That is, a user must select and wear an earpiece that is specifically constructed for use with a particular ear. A contemporary conchae bowl worn earpiece made for use in the right ear cannot be properly worn in the left ear and visa-versa.

As long as a dedicated earpiece is worn in the correct ear, then it is generally acceptably comfortable and will generally tend to stay in place. However, there is room for improvement in both the comfort and ability to remain in place associated with such contemporary earpieces.

It is particularly important that such earpieces remain securely in place within the ear during vigorous use. Frequently, it is during such vigorous use that communications provided by two-way radio are most critical.

It is also important that an earpiece be comfortable to wear. An uncomfortable earpiece can be a distraction. An attempt by a police officer or security person to adjust an earpiece, so as to make it more comfortable, may result in a missed communication or may be a distraction in itself that results in an unsafe situation.

If an attempt is made to use a contemporary earpiece in the wrong ear, it will not fit properly and therefore will be uncomfortable and subject to falling out. Thus, contemporary earpieces can only be used in the ear for which they were intended.

Of course, the use of such dedicated earpieces necessitates that separate left and right earpieces be purchased, maintained in inventory, and carried into the field by police and security personal. Purchasing and maintaining separate left and right earpieces in inventory is both costly and inconvenient.

Requiring that separate left and right earpieces be carried by police and security personnel in the field is undesirable. Such personnel have a strictly limited capacity to carry gear in the field. They can only carry a certain amount of gear and still remain effective in the performance of their duties.

Thus, although such contemporary dedicated earpieces have proven generally suitable for their intended purposes, they possess inherent deficiencies that detract from their overall effectiveness and desirability. To date, no contemporary earpiece can be worn in the conchae of either ear while allowing the wearer to adequately hear outside or ambient sound.

As such, although the prior art has recognized, to a limited extent, the need to provide earpieces for two-way radios, the proposed solutions have, to date, been ineffective in providing a satisfactory remedy. Therefore, it is desirable to provide a single earpiece that can be used in either ear, which is comfortable to wear, and which remains securely in place within the ear during vigorous use.

BRIEF SUMMARY OF THE INVENTION

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112, are to be accorded full statutory equivalents under 35 USC 112.

The present invention specifically addresses and alleviates the above-mentioned deficiencies associated with the prior art. More particularly, according to one aspect the present invention comprises a device for facilitating hearing, wherein the device comprises an earpiece that is configured to be captured at least partially within the conchae of an ear and wherein the earpiece is configured for use in either ear.

Preferably, the earpiece is open. That is, the earpiece has a substantial open area formed therein, such that outside or ambient sound can readily be heard while wearing the earpiece. Thus, both the radio and environment sound can both be heard while wearing the earpiece of the present invention.

Preferably, the earpiece comprises detents that are configured to be captured by the conchae. More particularly, the earpiece is preferably configured to be captured by protrusions of the conchae. Preferably, the earpiece is configured to be captured at least partially by the antihelix of the ear.

According to one aspect, the earpiece is preferably generally symmetric. More particularly, the earpiece is preferably generally symmetric about a plane that bisects the earpiece. Even more particularly, the earpiece is preferably generally symmetric about a horizontal plane that bisects the earpiece between the top and bottom thereof. The plane is defined with the earpiece approximately oriented as it is worn in the ear of a standing person. Thus, the plane is defined so as to define an earpiece that is suitable for ambidextrous use.

The earpiece is preferably configured such that one size thereof fits a range of sizes of ears. More particularly, the earpiece is preferably configured such that one size fits most adult ears. Even more particularly, the earpiece is preferably configured such that one size fits approximately 70% of the ears of men between 19 and 40 years old. Of course, other configurations of the earpiece may be made to fit other individuals or groups of individuals.

The earpiece is preferably comprised of at least one rib. More particularly, the earpiece is preferably comprised of at least one generally arcuate rib and at least one generally vertical rib, the generally vertical rib extending between points proximate ends of the arcuate rib. Thus, the earpiece is preferably comprised of two ribs that are generally configured to define a D.

Preferably, a boss having a bore formed therethrough is configured to extend at least partially into the ear canal. The boss is preferably tapered such that it becomes smaller in diameter the further into the ear it extends.

According to one aspect, the earpiece is formed of a resilient polymer. Preferably, the earpiece is formed of a resilient polymer having a Shore A durometer of between approximately 35 and approximately 45. More preferably, the earpiece is formed of a resilient polymer having a Shore A durometer of approximately 40. Preferably, the earpiece is comprised of ALPHA® PVC 3019-40/45.

Preferably, the earpiece is formed by injection molding, preferably using steel dies or molds. However, those skilled in the art will appreciate that various other methods of manufacturing are likewise suitable.

According to one aspect, the present invention comprises an ambidextrous earpiece that is suitable for use in either ear.

According to one aspect, the present invention comprises a portable communication system comprising a radio, an earpiece that is configured to be captured at least partially within the conchae of an ear, and an acoustic and/or electrical conduit that is configured to communicate information from the radio to the earpiece. The earpiece is configured for use in either ear.

According to one aspect, the present invention comprises an audio link for communicating sound to the ear. The audio link preferably comprises acoustic tubing and/or electric cable.

According to one aspect, the present invention comprises a transducer formed to the earpiece and an electric conduit for communicating a signal representative of sound to the transducer. That is, the transducer may optionally be formed directly to or proximate the boss or otherwise be formed to or proximate the earpiece, so as to eliminate the need for acoustic tubing.

The communications link may optionally comprise a wireless and/or tubeless communications link. For example, a radio communications link may be used to communicate a signal representative of sound to the earpiece of the present invention. Examples of such radio links include Bluetooth and WiFi radio links. Other types of wireless and/or tubeless communications links are also contemplated and include infrared and ultrasonic communications links. In each instance, the signal may be communicated from the portable two-way radio carried by the wearer or from a more remote source, such as a car radio, repeater, or base station.

According to one aspect, the present invention comprises a method for manufacturing an ambidextrous earpiece, wherein the method comprises forming an earpiece from a polymer material. Manufacturing is substantially simplified, since a single earpiece can be worn in either ear. Typically, only half the number of dies or molds are necessary with respect to contemporary earpiece manufacturing processes. That is, dies or molds for separate left and right ears are not needed since the earpieces of the present invention is ambidextrous.

Since only one earpiece is needed, according to the present invention, fitting thereof to an individual is made easier. The one size fits many aspect of the present invention further facilitates ease in fitting.

According to one aspect, the present invention comprises a method for using a portable communication system, wherein the method comprises inserting an earpiece into the conchae, and preferably at least partially into the ear canal as well, such that the earpiece is held in place at least partially by the conchae and wherein the earpiece is configured for use in either ear. The earpiece is preferably inserted into both the cymba (upper) conchae and the cavum (lower) conchae.

According to one aspect, the present invention comprises a method for using an earpiece, wherein the method comprises removing the earpiece from one ear and placing the earpiece in the other ear, such that the earpiece is held in place at least partially by the conchae. The earpiece may be held in place by the upper portion of the conchae, the lower portion of the conchae, the back, the crux and/or the ear canal.

According to one aspect, the present invention comprises a method for using an earpiece, wherein the method comprises inserting an earpiece into the conchae of the ear without regard as to which ear the earpiece is configured to be used in and wherein the earpiece is held in place at least partially by the conchae.

According to one aspect, the present invention comprises a method for using an earpiece, wherein the method comprises removing an earpiece from one ear and inserting the earpiece into the other ear.

According to one aspect, the present invention comprises an earpiece that is configured to be captured within the conchae of an ear by an antihelix, a back rim of the conchae, a tragus, and/or an antitragus. Preferably, a portion of the earpiece is captured between the crus of helix (within the conchae) and the antihelix. Preferably, a portion of the earpiece is captured between the crus of helix (within the conchae) and the antihelix and is also captured within the ear canal and leaves the bottom of the earpiece and/or the bottom of the ear canal substantially open, so as to readily allow outside sound to be heard.

The back side of the earpiece preferably follows the outline of the conchae rim at the back of the conchae bowl. If the conchae bowl is irregular, the earpiece of the present invention will generally conform to fit. If the conchae bowl is small, the earpiece will collapse to size. If the conchae bowl is large, the earpiece will flatten out to provide grab and support to the antihelix pad, and crus arch, and the acoustic tubing may push the earpiece against the ear. The acoustic tubing may apply pressure to provide additional grab at both the top and bottom of the ear for the lob at the bottom of the earpiece, so that the lob can grab into the shallow below the ear canal and against the tragus and the antitragus.

The holding ability of the earpiece of the present invention allows pulling loads to be applied both downwardly and upwardly while maintaining the earpiece desirably within the ear. Thus, the acoustic tubing, or any other component, may pull either downwardly upon the earpiece or upwardly thereupon without undesirably dislodging the earpiece from the ear.

According to one aspect, the present invention comprises an earpiece comprising a body that is configured for use in either ear and a acoustic coupler having a bore formed therein, the acoustic coupler being configured so as to facilitate attachment of acoustic tubing to the earpiece.

These, as well as other advantages of the present invention, will be more apparent from the following description and drawings. It is understood that changes in the specific structure shown and described may be made within the scope of the claims, without departing from the spirit of the invention.

BRIEF DESCRIPTION OF THE DRAWINGS

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
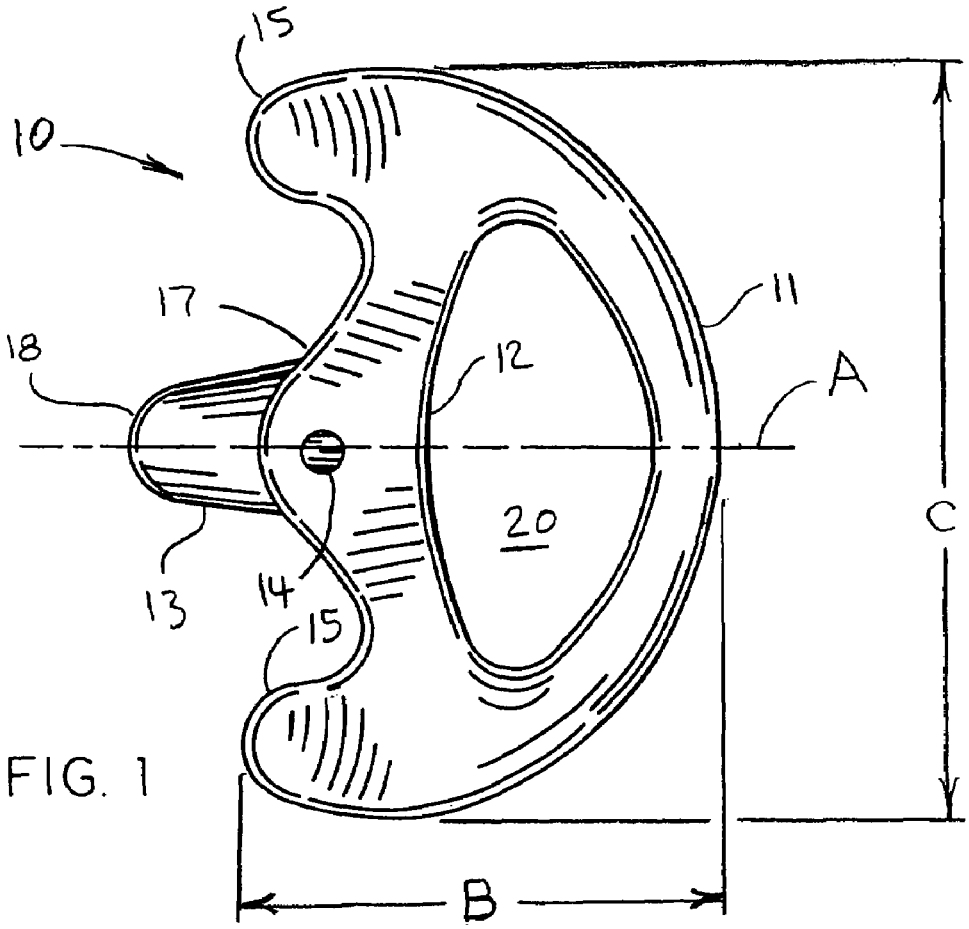
FIG. 1 is a side view of the ambidextrous earpiece of the present invention, showing the outer (away from the body) surfaces thereof.
Figure 2:
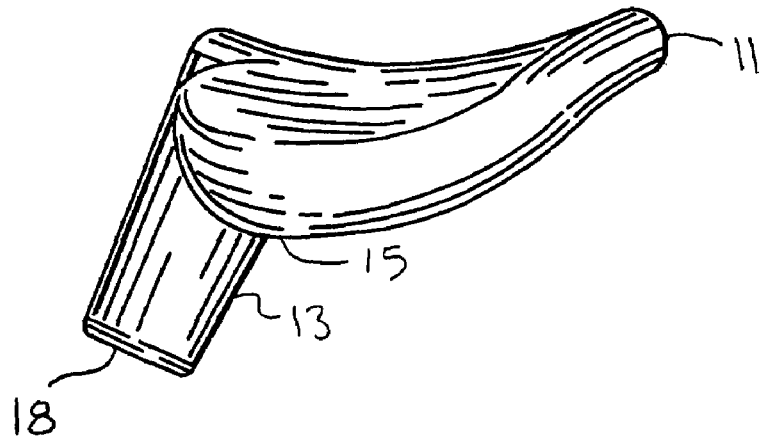
FIG. 2 is a bottom/top view of the ambidextrous earpiece of FIG. 1, showing the boss thereof.
Figure 3:
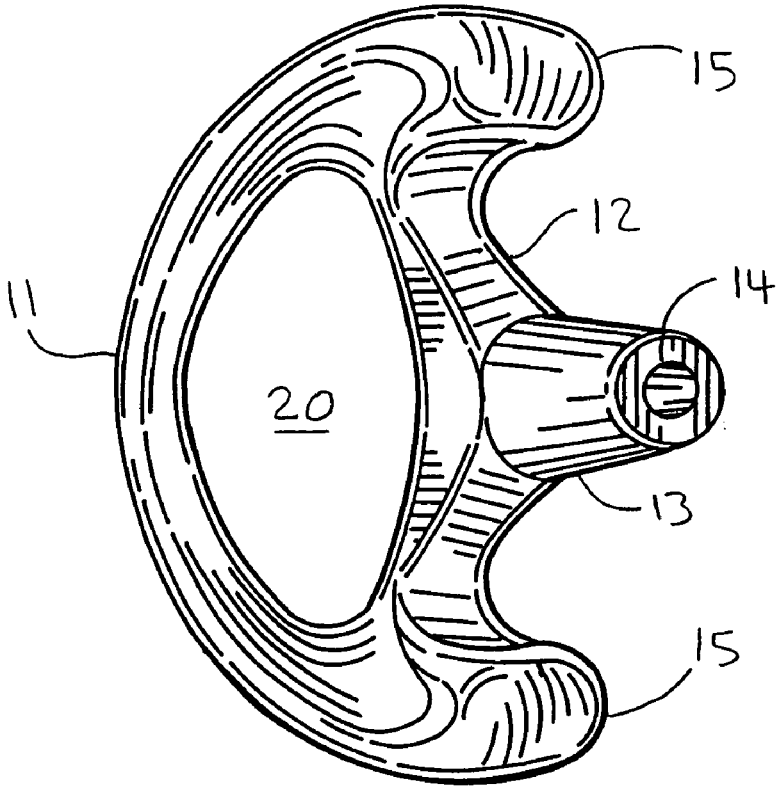
FIG. 3 is a side view of the ambidextrous earpiece of FIG. 1, showing the inner (toward the body) surfaces thereof.
Figure 4:
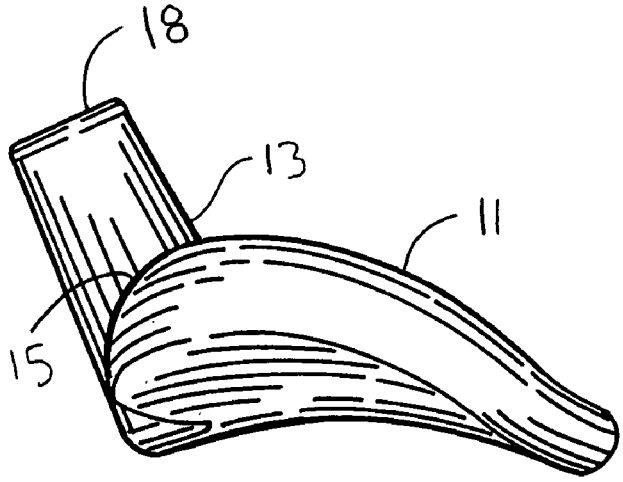
FIG. 4 is a top/bottom view of the ambidextrous earpiece of FIG. 1, showing the boss thereof.
Figure 5:
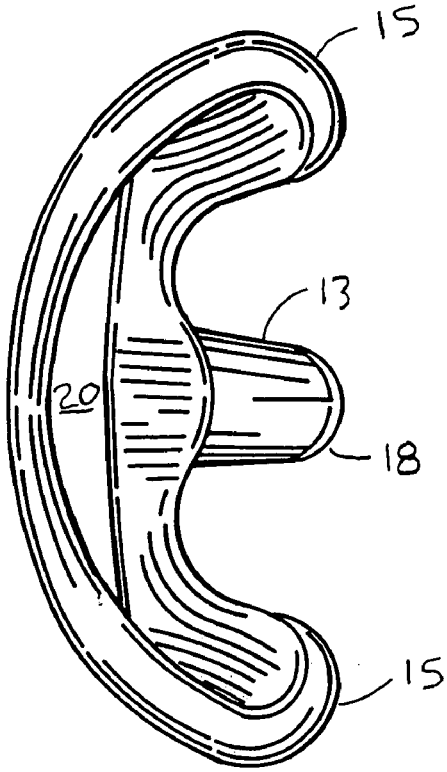
FIG. 5 is a perspective view of the ambidextrous earpiece of FIG. 1, showing the outer surfaces thereof.
Figure 6:
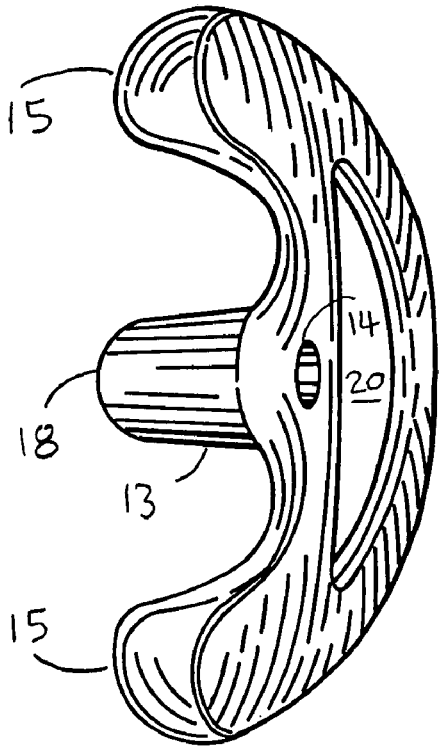
FIG. 6 is another perspective view of the ambidextrous earpiece of FIG. 1, showing the outer surfaces thereof.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

Thus, the detailed description set forth below in connection with the appended drawings is intended as a description of the presently preferred embodiment of the invention and is not intended to represent the only form in which the present invention may be constructed or utilized. The description sets forth the functions and the sequence of steps for constructing and operating the invention in connection with the illustrated embodiment. It is to be understood, however, that the same or equivalent functions may be accomplished by different embodiments that are also intended to be encompassed within the spirit of the invention.

The present invention is illustrated in FIGS. 1-7, which depict a presently preferred embodiment thereof.

Referring now to FIGS. 1-6, the ambidextrous earpiece 10 comprises a generally arcuate rib 11 and a generally vertical rib 12. The generally arcuate rib 11 and the generally vertical rib 12 are formed to one another and cooperate to generally define the letter D, as viewed in FIG. 1. Thus, an open area 20 is defined by the generally arcuate rib 11 and the generally vertical rib 12. The generally arcuate rib 11 and the generally vertical rib 12 are preferably formed integrally with respect to one another.

Lobes 15 are preferably formed proximate the intersections of the generally arcuate rib 11 and the generally vertical rib 12.

A boss 13 having a bore 14 formed therethrough is preferably formed to the generally vertical rib 12, preferably at a portion 17 of increased width thereof. The boss 13 is preferably configured so as to fit at least partially within a wearer's ear canal. The boss 13 is preferably slightly tapered such that the diameter thereof decreases toward the distal end 18 thereof.

The earpiece 10 is configured such that ambient sound is easily heard in the ear in which the earpiece is being worn. Those skilled in the art will appreciate that police and security personal must be able to hear ambient sound in order to assure their safety. It is also important that ambient sound be heard through both ears, such that lower volume sounds can easily be heard and such that the direction of the source of the sound can readily be ascertained.

The open area 20 facilitates the hearing of ambient sounds. That is, the open area 20 readily facilitates the introduction of ambient sound into the ear.

The tapered boss 13 is preferably configured such that ambient sound can enter the ear canal and travel through the ear canal between the boss 13 and the sides of the ear canal. That is, the boss 13 is preferably substantially smaller in diameter that the ear canal at any given location along the length of the boss 13, such that ambient sound may readily propagate along the ear canal.

The bore 14 both facilitates the attachment of acoustic coupler 71 (FIG. 7) and also serves as an acoustic conduit, as discussed in detail below.

The ambidextrous earpiece of the present invention is generally symmetric in construction. Preferably, the ambidextrous earpiece of the present invention is generally symmetric about an approximately horizontal (with the earpiece oriented as it is when inserted within an ear) plane that bisects the earpiece between the top and bottom halves thereof, as indicated by line A of FIG. 1. This symmetry allows the ambidextrous earpiece of the present invention to be rotated such that it is suitable for use in either ear.

That is, if the ambidextrous earpiece of the present invention as shown in FIG. 1 is oriented such that it is suitable for use in the left ear, then to use the same ambidextrous earpiece in the right ear the earpiece must be flipped over or rotated about line A.

One advantage of the D shaped construction of the present invention is that it permits a single sized to be defined such that the single size fits a large number of men between 19 and 40 years old. Preferably, a single size is defined such that it fits approximately 70% of men between 19 and 40 years old. That single size preferably has a width, Dimension B, of approximately 13/16 inch and preferably has a height, Dimension C, of approximately 1⅛ inch.

Moreover, the earpiece of the present invention tends to bend or reshape itself so as to comfortably accommodate a wide variety of shapes and sizes of ears. The construction of the earpiece thus facilitates use by a large number of individual and also enhance comfort during the wearing thereof.

The generally arcuate rib 11 and the generally vertical rib 12 cooperate with one another so as to collapse sufficiently when worn such that they accommodate a wide variety of ear sizes.

The earpiece of the present invention preferably generally follows the outline of the conchae bowl and reshapes to fit larger or smaller ears. A lob of the earpiece preferably extends under the antihelix, extends across the conchae cymba, arches, and slopes over the crus of helix.

The ambidextrous earpiece of the present invention is preferably formed by injection molding. However, those skilled in the art will appreciate that other processes may be used. For example, various other molding processes are likewise suitable.

The ambidextrous earpiece is preferably formed of a material having a shore A durometer of between approximately 35 and approximately 45. The ambidextrous earpiece is more preferably formed of a material having a shore A durometer of approximately 40.

The ambidextrous earpiece of the present invention is preferably formed of a resilient polymer material such as ALPHA® PVC 3019-40/45, provided by ALPHAGARY of Leominster, Mass.

The use of such soft, pliable and resilient material substantially enhances the safety of the earpiece. The earpiece of the present invention is less likely to cause trauma in the event of an accident that pushes thereagainst, as compared to contemporary earpieces made of a more rigid material. Thus, if a police officer is hit in the ear, the likelihood of serious injury is mitigated.

Figure 7:
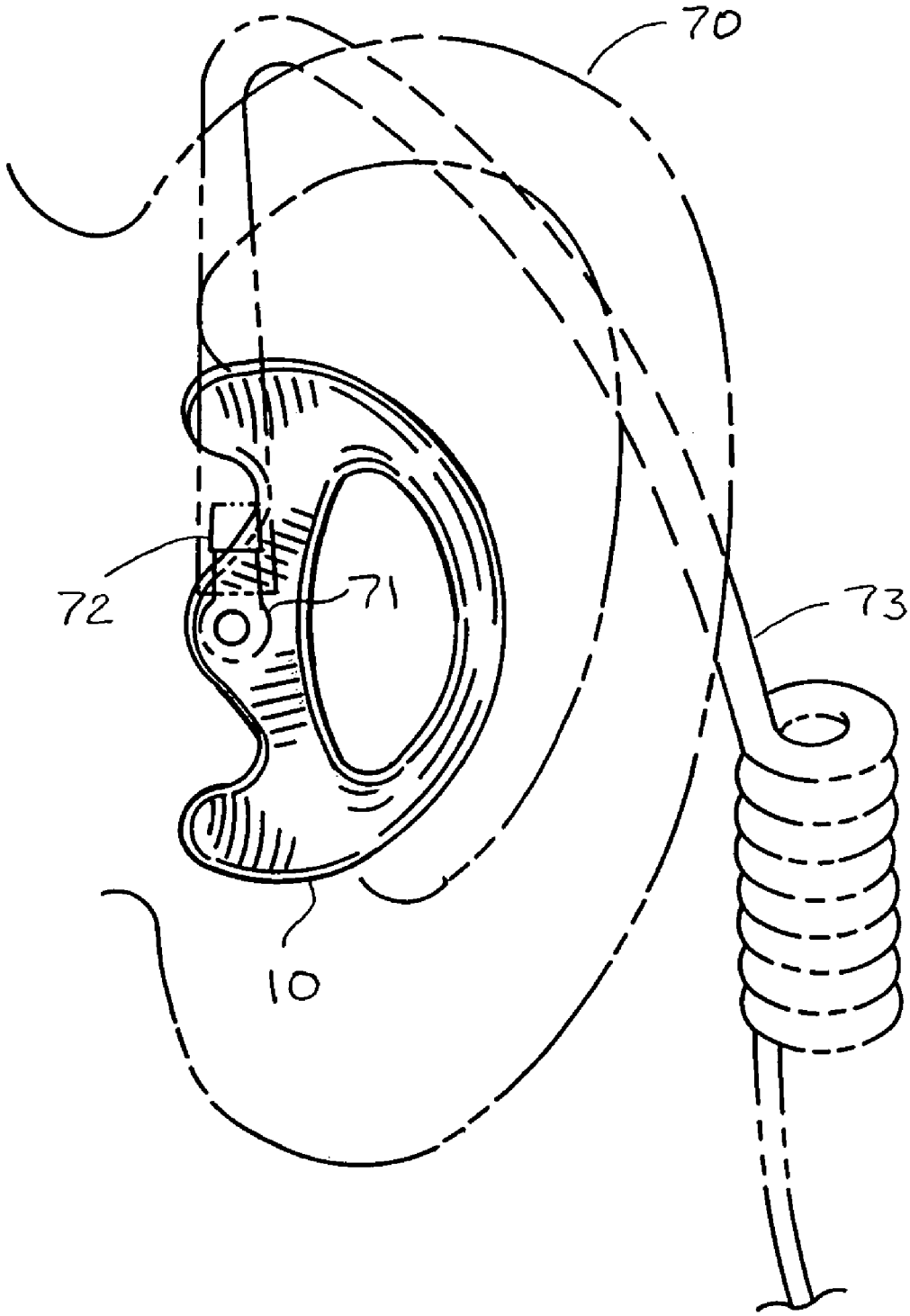
FIG. 7 is a side view of the ambidextrous earpiece of FIG. 1, shown inserted into and captured by the conchae of an ear and having a communications link attached thereto.

Referring now to FIG. 7, the ambidextrous earpiece of the present invention is shown inserted into a person's ear 70. The ambidextrous earpiece fits into the conchae or conchae bowl of a human ear and is captured by the anatomical structures of the ear such that it is held securely in place during use. The conchae or conchae bowl is comprised of both the cymba conchae and the cavum conchae.

More particularly, the ambidextrous earpiece is configured such that it is held in place within the ear by protrusions of the conchae. According to the preferred embodiment of the present invention, the ambidextrous earpiece is configured such that it is captured and held in place at least partially by the antihelix.

Preferably, the ambidextrous earpiece comprises at least one, preferably a plurality, of detents that engage the anatomical structures of the ear so as to hold the earpiece in place therein. The detents of the ambidextrous earpiece are defined as those portions thereof which engage anatomical portions of the ear so as to hold the earpiece in place therein.

More particularly, the present invention preferably comprises an earpiece that is configured so as to be captured within the conchae of an ear by the antihelix, the back rim of the conchae, the tragus, and/or the antitragus. Preferably, a portion of the earpiece is captured between the crus of helix (within the conchae) and the antihelix.

The present invention preferably comprises an earpiece that is configured such that it follows a rim of the ear and is thus held in place within the conchae. Thus, the earpiece conforms to one or more contours of the ear within the conchae.

The terms describing the anatomy of the ear used herein are generally consistent with the terms defined in the illustration found on the Internet at http://www.ghorayeb.com/AnatomyAuricle.html, the contents of which are hereby incorporated by reference.

An acoustic coupler 71 is inserted into the bore 14 of the ambidextrous earpiece. The acoustic coupler preferably comprises a bent or right angle post, so as to position the acoustic tubing 73 such that it goes upwardly therefrom, as shown in FIG. 7. The acoustic coupler 71 preferably has at least one barbed fitting formed thereon so as to facilitate secure attachment to the acoustic tubing 73. The acoustic coupler 71 preferably has at least one similarly barbed fitting that facilitates attachment to the ambidextrous earpiece 10.

In operation, the ambidextrous earpiece of the present invention is placed in a desired ear 70 such that it is held therein by the anatomical structures of the ear 70. The boss 18 is at least partially within the ear canal. The acoustic tubing goes up from the ambidextrous earpiece, over the top of the ear 70, and down behind the ear 70.

When it is desired to change ears, the wearer merely removes the ambidextrous earpiece from one ear, rotates the earpiece 180 degrees about the post of the acoustic coupler 71, rotates the acoustic coupler 180 degrees about its connection to the acoustic tubing 73, and inserts the ambidextrous earpiece into the other ear.

This procedure, of course, greatly simplifies the contemporary process of removing the old earpiece from the post, searching for and finding the new earpiece, attaching the new earpiece to the post, orienting (rotating) the new earpiece correctly with respect to the acoustic coupler and the acoustic tubing, and inserting the new earpiece into the other ear.

The ambidextrous earpiece of the present invention provides a single earpiece that can be used in either ear, which is comfortable to wear, and which remains securely in place within the ear during vigorous use.

As discussed above, the use of contemporary dedicated earpieces necessitates that separate left and right earpieces be manufactured, purchased, maintained in inventory, and carried by police and security personal. Manufacturing separate left and right earpieces substantially increases the cost of manufacture. Purchasing and maintaining separate left and right earpieces in inventory is both costly and inconvenient. The use of the ambidextrous earpiece of the present invention eliminates the need to manufacture and buy separate left and right earpieces and thus simplifies purchasing and inventory problems while reducing costs.

Further, use of the ambidextrous earpiece of the present invention necessitates that only a single earpiece be carried in the field by police and security personal. Thus, it is not necessary for such users to carry a separate earpiece for each ear. Use of the ambidextrous earpiece also eliminates the need to look for the another earpiece when changing ears is desired, since the same earpiece may be used.

Further, the need to remove the old earpiece and install the new earpiece is eliminated, since the use of the ambidextrous earpiece of the present invention simply requires that the original earpiece be rotated for use in a different ear.

It is worthwhile to appreciate that the present invention affords advantages with respect to the prior art even if a user never changes ears. Since only one earpiece needs to be purchased and maintained in inventory, inventory purchases are simplified and generally fewer earpieces must be stored. Inventory processes are simplified because one less item needs to be kept. Fewer pieces are likely to be needed because of the interchangeability of the ambidextrous earpieces of the present invention.

The ambidextrous earpiece of the present invention may be used by various different police, security and public safety personnel. Indeed, the ambidextrous earpiece of the present invention may be used by anyone to facilitate cell phone communications, to listen to music such as from a portable music player like a radio, CD player, or MP3 player, and may be used in various other applications. More particularly, the earpiece of the present invention may be worn while simultaneously allowing outside or ambient sound to be readily heard.

By allowing ambient sound to be heard, stereo hearing of ambient sounds, which is important for police, security, and safety personnel, is maintained. The ability to hear stereo sound is also important in many civilian applications. For example, it is very important that a bicyclists ear well from both ears, so that the locations of important items, such as approaching cars, can be readily determined.

Moreover, the earpiece of the present invention can be worn in the conchae of either ear while allowing the wearer to adequately hear outside or ambient sound.

It is understood that the exemplary ambidextrous earpiece described herein and shown in the drawings represents only a presently preferred embodiment of the invention. Indeed, various modifications and additions may be made to such embodiment without departing from the spirit and scope of the invention. For example, those skilled in the art will appreciate that various structures other than the general D configuration of the present invention are likewise suitable.

Thus, these and other modifications and additions may be obvious to those skilled in the art and may be implemented to adapt the present invention for use in a variety of different applications.

The invention claimed is:

1. A device for facilitating hearing, the device comprising:

a symmetric earpiece configured to be captured at least partially within the conchae of an ear, the earpiece comprising at least one generally arcuate rib and at least one generally vertical rib, the generally vertical rib extending between points proximate ends of the arcuate rib;

an acoustic conduit configured so as to cause sound to pass through the earpiece; and wherein the earpiece is configured for use in either ear by re-orienting the earpiece without re-configuring the earpiece.

2. The device as recited in claim 1, wherein the earpiece comprises detents configured to be captured by the conchae.

3. The device as recited in claim 1, wherein the earpiece is configured to be captured by protrusions of the conchae.

4. The device as recited in claim 1, wherein the earpiece is configured to be captured at least partially by the antihelix of the ear.

5. The device as recited in claim 1, wherein the earpiece is generally symmetric about a plane that bisects the earpiece.

6. The device as recited in claim 1, wherein the earpiece is generally symmetric about a plane that bisects the earpiece between the top and bottom thereof.

7. The device as recited in claim 1, wherein the earpiece is configured such that one size thereof fits a range of sizes of ears.

8. The device as recited in claim 1, wherein the earpiece is configured such that one size fits most adult ears.

9. The device as recited in claim 1, wherein the earpiece is formed of a resilient polymer.

10. The device as recited in claim 1, wherein the earpiece is formed of a resilient polymer having a Shore A durometer of between approximately 35 and approximately 45.

11. The device as recited in claim 1, wherein the earpiece is formed of a resilient polymer having a Shore A durometer of approximately 40.

12. The device as recited in claim 1, wherein the earpiece is formed by injection molding.

13. A method for manufacturing an earpiece, the method comprising:

forming an earpiece from a polymer material;

wherein the earpiece is configured to be captured at least partially within the conchae of an ear;

wherein the earpiece comprises a generally arcuate rib and a generally vertical rib formed so as to generally define the letter D, and also comprises a boss having a bore formed therethrough, the boss being formed to the generally vertical rib; and wherein the earpiece is sufficiently symmetrical to be configured for use in either the right or left ear.

14. The method as recited in claim 13, wherein the polymer material comprises a resilient polymer material.

15. The method as recited in claim 13, wherein the earpiece is formed by injection molding.

16. A method for using a portable communication system, the method comprising:

inserting an earpiece into the ear such that the earpiece is held in place at least partially by the conchae;

wherein the earpiece comprises a generally arcuate rib and a generally vertical rib formed so as to generally define the letter D, and also comprises a boss having a bore formed therethrough, the boss being formed to the generally vertical rib; and wherein the earpiece is sufficiently symmetrical to be configured for use in either the right or left ear.

17. A method for using an earpiece, the method comprising:

removing the earpiece from one ear;

re-orienting the earpiece without re-configuring the earpiece;

placing the earpiece in the other ear such that the earpiece is held in place at least partially by the conchae;

wherein the earpiece comprises a generally arcuate rib and a generally vertical rib formed so as to generally define the letter D, and also comprises a boss having a bore formed therethrough, the boss being formed to the generally vertical rib; and wherein the earpiece is sufficiently symmetrical to be configured for use in either the right or left ear.

18. An earpiece configured to be captured within the conchae of an ear by at least one of:

an antihelix;

a back rim of the conchae;

a tragus;

an antitragus;

wherein the earpiece comprises a generally arcuate rib and a generally vertical rib formed so as to generally define the letter D, and also comprises a boss having a bore formed therethrough, the boss being formed to the generally vertical rib; and wherein the earpiece is sufficiently symmetrical to be configured for use in either the right or left ear.

19. The earpiece as recited in claim 18, wherein a portion thereof is captured between a crus of helix and the antihelix.

20. An earpiece comprising:

a generally arcuate rib;

a generally vertical rib;

a boss formed upon the vertical rib and configured to at least partially enter an ear canal;

a bore formed through the boss;

wherein the arcuate rib and the vertical rib cooperate to generally define the letter D;

wherein the boss, the arcuate rib, and the vertical rib are symmetrical about a plane that bisects the earpiece between top and bottom halves thereof;

wherein the earpiece is configured to be captured at least partially within the conchae of the ear; and wherein the earpiece is configured for use in either ear by re-orientating the earpiece without re-configuring the earpiece.

21. A device for facilitating hearing, the device comprising:

a symmetric earpiece configured to be captured at least partially within the conchae of an ear, the earpiece comprising two ribs that are generally configured to define a D;

an acoustic conduit configured so as to cause sound to pass through the earpiece; and wherein the earpiece is configured for use in either ear by re-orienting the earpiece without re-configuring the earpiece.

22. A device for facilitating hearing, the device comprising:

a symmetric earpiece configured to be captured at least partially within the conchae of an ear, the earpiece comprising a boss having a bore formed therethrough, the boss being configured to extend at least partially into the ear canal;

an acoustic conduit configured so as to cause sound to pass through the earpiece; and wherein the earpiece is configured for use in either ear by re-orienting the earpiece without re-configuring the earpiece.

* * * * *